US011249423B2

(12) United States Patent
Ogura et al.

(10) Patent No.: US 11,249,423 B2
(45) Date of Patent: Feb. 15, 2022

(54) IMAGE FORMING APPARATUS

(71) Applicant: Konica Minolta, Inc., Tokyo (JP)

(72) Inventors: Keigo Ogura, Tokyo (JP); Naoto Sugaya, Hachioji (JP); Hiroshi Yamaguchi, Toyokawa (JP); Tatsuo Ishizuka, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/219,686

(22) Filed: Mar. 31, 2021

(65) Prior Publication Data

US 2021/0311417 A1 Oct. 7, 2021

(30) Foreign Application Priority Data

Apr. 2, 2020 (JP) ..... JP2020-066395

(51) Int. Cl.
*G03G 15/16* (2006.01)
*G03G 15/00* (2006.01)

(52) U.S. Cl.
CPC ..... *G03G 15/161* (2013.01); *G03G 15/505* (2013.01); *G03G 15/5008* (2013.01); *G03G 15/6555* (2013.01)

(58) Field of Classification Search
CPC ..... G03G 15/161; G03G 15/1605; G03G 15/1615
See application file for complete search history.

(56) References Cited

U.S. PATENT DOCUMENTS

2011/0293307 A1* 12/2011 Ogata ..... G03G 15/161 399/66
2017/0364011 A1* 12/2017 Seki ..... G03G 15/1615
2020/0255248 A1* 8/2020 Ishikawa ..... G03G 15/5054

FOREIGN PATENT DOCUMENTS

JP 2008-304552 A 12/2008
JP 2009-009103 A 1/2009
JP 2011248112 A * 12/2011 ..... G03G 15/168
JP 2013-250343 A 12/2013

* cited by examiner

*Primary Examiner* — Thomas S Giampaolo, II
(74) *Attorney, Agent, or Firm* — Squire Patton Boggs (US) LLP

(57) ABSTRACT

Provided is an image forming apparatus including an image carrier, a transfer unit, a driver, a hardware processor, an adjustment mechanism, and a speed detector. The hardware processor sets a command value. The hardware processor performs a constant-torque control based on a constant-speed drive torque detected in a constant-speed control. In the constant-torque control, the hardware processor performs a feedback control to set a reference value to an average speed of the driver during passage of a first sheet and calculate a difference from an average speed during passage of a subsequent sheet so as to derive the command value. The hardware processor determines whether a load torque increase, its factor, and/or its influence exceeds a threshold, and forcibly sets the reference value to a speed detected while a pressure between the transfer unit and the image carrier is reduced by the adjustment mechanism from the pressure during image transfer.

8 Claims, 9 Drawing Sheets

(A)

(B)

(C)

(D)

IMAGE FORMING APPARATUS

CROSS-REFERENCE TO RELATED APPLICATIONS

The entire disclosure of Japanese Patent Application No. 2020-066395 filed on Apr. 2, 2020 is incorporated herein by reference in its entirety.

BACKGROUND

Technological Field

The present invention relates to an image forming apparatus that presses a transfer unit against an image carrier with a toner image, feeds a paper sheet between the image carrier and the transfer unit pressed against each other, and thereby transfers the toner image onto the image carrier.

Description of the Related Art

Image forming apparatuses with functions of a printer, facsimile, copier, MFP, etc. are widespread in recent years. In such image forming apparatuses, a latent image is formed on a photoreceptor based on image data and developed with developing materials, and is transferred onto a paper sheet directly or via an intermediate transfer unit. A transfer unit composed of a transfer roller, a transfer belt, etc. is pressed against an image carrier composed of a photoreceptor, an intermediate transfer unit, etc., and a paper sheet is inserted into a pressed part (transfer nip part). A toner image is thereby transferred onto the paper sheet.

The transfer unit may be pressed against and thereby driven by the image carrier that is rotationally driven. However, when a load is applied to the transfer unit, it is difficult for the image carrier to drive the transfer unit, and there needs to be a transfer unit driver for rotationally driving the transfer unit. For example, with a cleaner for removing a toner image adhering onto the transfer unit, a blade or the like is pressed onto the surface of the transfer roller or the transfer belt of the transfer unit, and a load is thereby applied to the transfer unit. Thus, the image forming apparatuses include a transfer unit driver for driving the transfer unit.

In such a case where the image carrier and the transfer unit are individually rotationally driven, it is necessary to prevent rotation of the transfer unit from affecting rotation of the image carrier and the image formation accuracy from deteriorating. In JP2008304552A, the drive power to be applied to the transfer unit is controlled according to at least one of the cleaner usage and the water amount in the air, and thereby variation of the load applied to the image carrier by the rotation of the transfer unit is decreased. In JP2009009103A, a torque command value of the intermediate transfer unit is detected, and the speed of the transfer unit is varied if the command value exceeds a predetermined lower limit, thereby preventing disruption of the control of the intermediate transfer unit.

However, as a paper sheet passes through the pressed part when the transfer unit is pressed against the image carrier (the intermediate transfer belt here) and rotationally driven, the rotation diameter of the transfer unit is deviated by the thickness of the paper sheet. Thus, in the case where the transfer unit is controlled to rotate at a constant speed in a constant-speed control, a torque applied to the image carrier is varied between cycles of passage of sheets, resulting in speed variation of the image carrier. That causes a problem such as a coloring error and deterioration of the image formation accuracy.

To deal with such torque variation, there have been proposed image forming apparatuses in which a constant-torque control is performed in the transfer unit while the transfer unit and the image carrier are pressed against each other according to a constant-speed drive torque that is detected while the transfer unit is separated from the image carrier.

However, in the case where the constant-torque control is performed while the fixing unit is pressed against the intermediate transfer belt, a transfer load of the transfer unit is varied over time, and the image magnification ratio is varied by the variation in the transfer load. FIG. 8A shows variation in the transfer load in the transfer unit, and FIG. 8B shows an image magnification ratio. The vertical axis is the transfer load, and the horizontal axis is the time in FIG. 8A. The vertical axis is the image magnification ratio, and the horizontal axis is the time in FIG. 8B. In the FIG. 8B, the square-shaped points plots the average speed of the transfer unit (driver) when each sheet passes through. The same applies to the succeeding drawings.

As shown in FIG. 8A, the transfer load is gradually decreased as the image transfer is continuously performed onto the first sheet, the second sheet, the third sheet, and so on. The variation in the transfer load itself is adequately slow, and has been considered to be caused by alteration in materials of the transfer unit or the cleaning unit over time (gradual alteration of materials throughout life). However, in fact, the transfer load is greatly varied by the cleaning configuration (lubricant application, etc.) of the transfer unit, and is changed in a short term by several tens of sheets. As the transfer load is decreased as described above, the rotation speed of the transfer unit is likely to be increased, resulting in an increase (extension) in the image magnification ratio.

In a method proposed as a solution to such a problem, the average speeds of the transfer unit in passage of sheets are compared, and the difference between one sheet and its subsequent sheet is fed back to the torque command value for the next sheet. FIG. 9 is an explanatory drawing showing a method of feedback of the difference to the next sheet. Section A in FIG. 9 shows variation in the transfer load in the transfer unit, in which the vertical axis is the transfer load and the horizontal axis is the elapsed time. Section B in FIG. 9 shows the torque command value (PWM) in the transfer unit, in which the vertical axis is the torque command value and the horizontal axis is the elapsed time. Section C in FIG. 9 shows the speed of the driver that drives the transfer unit, in which the vertical axis is the speed and the horizontal axis is the elapsed time. Section D in FIG. 9 shows the magnification ratio of the image to be transferred onto the sheet, in which the vertical axis is the image magnification ratio and the horizontal axis is the elapsed time.

As sheets pass through with the transfer unit being pressed against them, the transfer load is gradually decreased due to influence of the lubricant, etc. (Section A of FIG. 9). The driver drives the transfer unit based on the torque command value in a constant-speed control that is detected while the transfer unit is separated.

At this time, the average speed Va of the transfer unit during passage of the first sheet (hereinafter also referred to as the reference speed) is measured (Section C of FIG. 9), and the measured value is memorized as the reference value. Next, the average speed Vb of the transfer unit during passage of the second sheet is measured (Section C of FIG.

9), and the measured value for the second sheet is compared with the reference value for the first sheet. Then, the difference G1 between the values is fed back to the torque command value for the third sheet (feedback control). As the difference G1 is fed back, the command value for the third sheet is smaller than that for the second sheet (Section B of FIG. 9), and the average speed Vc of the driver may be returned to the reference speed. This makes it possible to maintain the image magnification ratio for the third sheet at the same value as that for the first sheet (Section D of FIG. 9). Such feedback control is performed for the third and subsequent sheets.

However, there is a problem in the method described above. In a case where trays are changed for the sheet type change in a print job involving sequential image formation, the image magnification ratio is varied after the tray change.

Specifically, as shown in FIG. 9, for the fifth sheet, the transfer unit is driven according to the torque command value for the fourth sheet before the tray change, but the average speed (rotation speed) Vd of the driver is decreased as the sheet type is changed to a thicker sheet. The back surface of the fifth sheet (on the transfer unit side) is conveyed at a speed equal to that of the transfer unit which is slower, but the front surface (on the intermediate transfer belt side) is conveyed at a speed equal to that of the intermediate transfer belt. Thus, it is possible to obtain an appropriate image magnification ratio, because the front surface of the fifth sheet is conveyed at a speed equal to that of the intermediate transfer belt (Section A of FIG. 9D).

For the sixth sheet, the measured value of the average speed of the driver Vd is compared with the reference value for the first sheet before the tray change, and the difference G2 is fed back to the torque command value for the sixth sheet. Therefore, the average speed Ve of the transfer unit for the sixth sheet is returned to the reference speed, but the speed on the front surface of the concerning sheet is also increased. That may cause slippage from the intermediate transfer belt and increase the image magnification ratio of the sixth sheet after the tray change (Section B of FIG. 9D).

In order to solve such a problem, the invention disclosed in JP2013250343A teaches that, in the case where trays are changed in a continuous operation, an average speed of the driver obtained in passage of the first sheet after the tray change through the transfer unit is set as a reference value, and a command value for the next sheet is calculated from differences between the reference value and the measured values of the average speeds of the driver obtained in passage of the second and subsequent sheets through the transfer unit after the tray change so that the image magnification ratio in the whole job is maintained even after the sheet types are changed by the tray change.

SUMMARY

However, in some cases, the image magnification ratio is gradually varied when the trays are changed in a continuous operation and the average speed of the transfer unit drive motor during passage of the first sheet after the tray change is repeatedly memorized as the reference speed (no absolute value).

For example, even when sheets are fed from more than one trays in a job involving different types of sheets, the secondary transfer may be performed without separating the transfer unit and the sheets may continuously pass. In that case, however, the load gets heavy due to saturation of the amount of the lubricant caused by idling while no sheet is fed for the secondary transfer. That increases the load torque more than expected and decreases the average speed of the transfer unit drive motor, possibly affecting the image magnification ratio after the tray change.

On contrary, it is not efficient to separate the transfer unit and reobtain a drive torque for a constant speed in a continuous operation because it takes time.

The present invention has been conceived in view of the above problems in the prior art, and has an object of maintaining a normal magnification ratio of transfer images in a whole job in which a toner image is serially transferred onto multiple sheets.

To achieve at least one of the abovementioned objects, according to an aspect of the present invention, an image forming apparatus reflecting one aspect of the present invention includes:

an image carrier that carries a toner image;

a transfer unit that is capable of being pressed against and separated from the image carrier and that transfers the toner image carried by the image carrier onto a sheet when the transfer unit is pressed against the image carrier;

a driver that rotationally drives the transfer unit according to a command value;

a hardware processor that sets the command value for a constant-speed control and a constant-torque control of the driver;

wherein in the constant-speed control, the driver drives the transfer unit at a constant speed, wherein in the constant-torque control, the driver drives the transfer unit with a constant torque, an adjustment mechanism that adjusts a pressure with which the transfer unit is pressed against the image carrier; and a speed detector that detects a speed of the driver, wherein the hardware processor performs the constant-torque control of the driver based on a constant-speed drive torque while the transfer unit is pressed against the image carrier, the constant-speed drive torque being detected in the constant-speed control of the driver while the transfer unit is separated from the image carrier, wherein in the constant-torque control, the hardware processor performs a feedback control in which the hardware processor sets a reference value to an average speed of the driver during passage of a first sheet through the transfer unit and calculates a difference between the reference value and a measured value of an average speed of the driver during passage of a second or subsequent sheet through the transfer unit so as to derive the command value for a sheet next to the second or subsequent sheet from the difference, wherein the hardware processor measures at least one of an increase in a load torque, a factor of the increase, and influence of the increase and makes a determination as to whether a measurement result exceeds a threshold value, and in response to the measurement result exceeding the threshold value, the hardware processor performs the feedback control in which the hardware processor forcibly sets the reference value to the speed of the driver that is detected by the speed detector while the pressure is reduced by the adjustment mechanism from a value during image transfer.

BRIEF DESCRIPTION OF THE DRAWINGS

The advantages and features provided by one or more embodiments of the invention will become more fully understood from the detailed description given herein below and the appended drawings which are given by way of illustration only, and thus are not intended as a definition of the limits of the present invention, wherein.

DETAILED DESCRIPTION OF THE EMBODIMENTS

Hereinafter, an embodiment of the present invention is described with reference to the drawings. However, the scope of the invention is not limited to the disclosed embodiments.

<1> Overview of Image Forming Apparatus

[Exemplary Configuration of Image Forming Apparatus]

Figure 1:
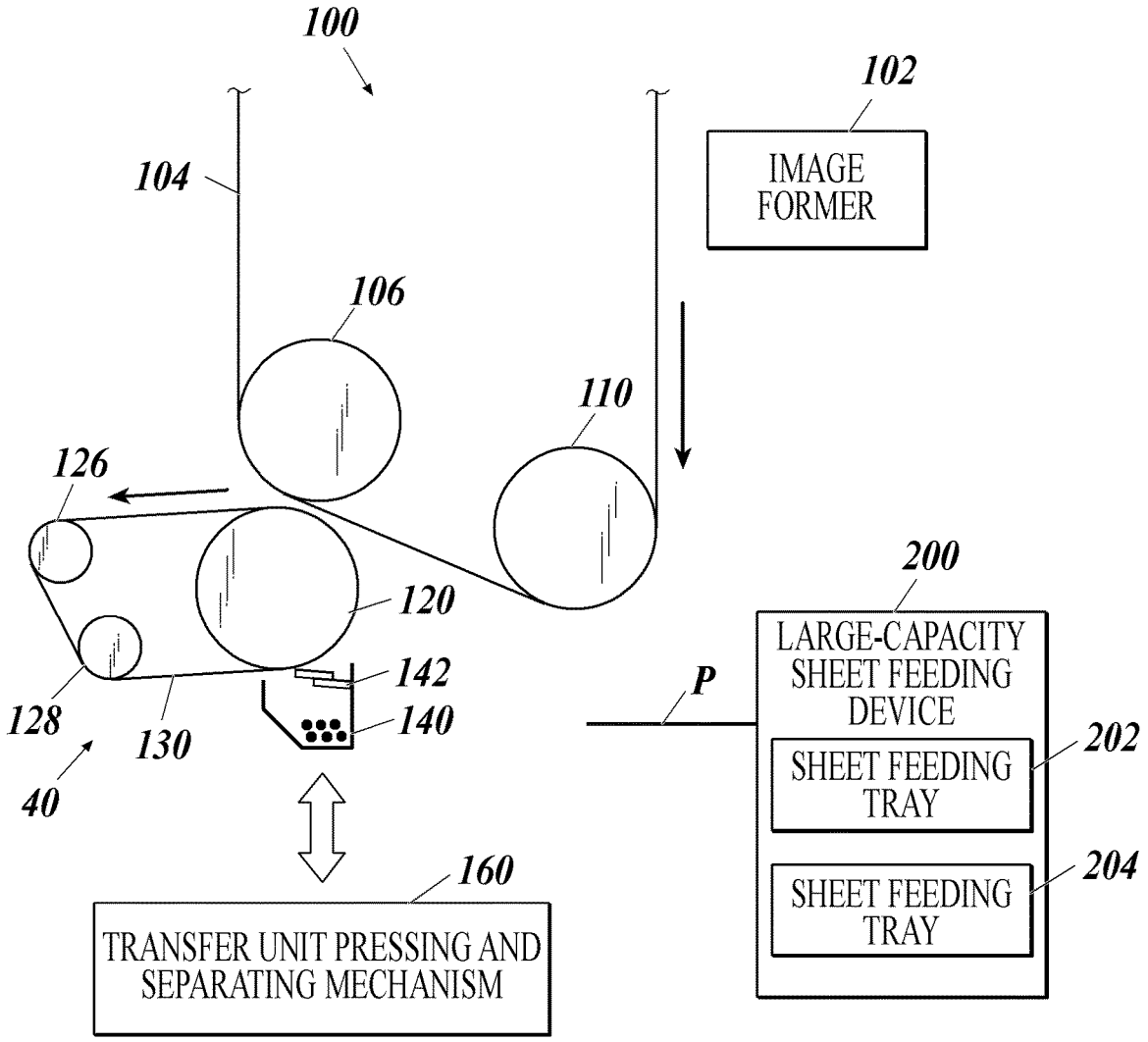
FIG. 1 schematically shows an exemplary configuration of a transfer unit of an image forming apparatus according to an embodiment of the present invention.
Figure 2:
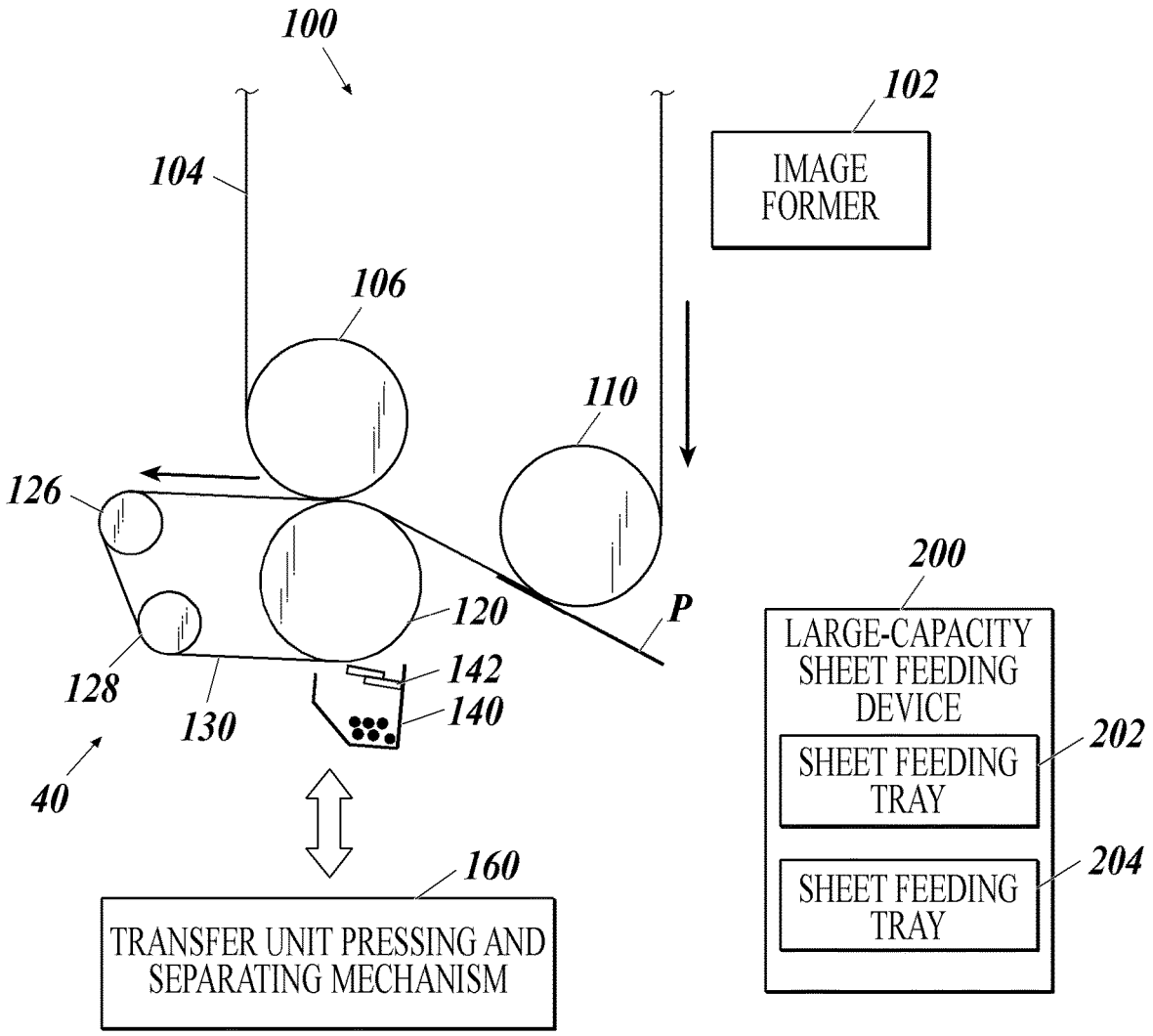
FIG. 2 schematically shows an exemplary configuration of the transfer unit of the image forming apparatus according to an embodiment of the present invention.

First, an exemplary configuration of an image forming apparatus 100 is described. FIG. 1 schematically shows an exemplary configuration of a transfer unit in a separated state of the image forming apparatus 100, and FIG. 2 schematically shows an exemplary configuration of the transfer unit in a pressed state of the image forming apparatus 100. The dimensional ratios of the drawings are expanded for convenience of explanation, and may be different from the actual ratios.

As shown in FIGS. 1 and 2, the image forming apparatus 100 includes an image former 102, an intermediate transfer belt 104, an image carrier drive roller 110, an image carrier driven roller 106, a transfer roller 120, a transfer unit drive roller 126, a transfer unit driven roller 128, a transfer unit drive belt 130, a cleaner 140, and a transfer unit pressing and separating mechanism 160.

A transfer unit 30 includes, for example, the image carrier drive roller 110, the transfer roller 120, the transfer unit drive roller 126, the transfer unit driven roller 128, the transfer unit drive belt 130, and the cleaner 140.

The image former 102 includes, for example, a photosensitive drum, an optical writer, a developer, and a charger not shown in the drawings]. The charger consistently charges the photosensitive drum to a predetermined potential. The optical writer forms the latent image on the photosensitive drum based on image information. The developer develops the latent image (toner image) formed on the photosensitive drum. The photosensitive drum, which is an example of the image carrier, transfers the toner image carried by the photosensitive drum onto the intermediate transfer belt 104.

The intermediate transfer belt 104, which is an example of the image carrier, is an endless belt, and is extended by the image carrier drive roller 110, the image carrier driven roller 106, and a driven roller not shown in the drawings. The image carrier drive roller 110 is rotationally driven by a motor described later, and conveys the intermediate transfer belt 104 in the conveyance direction of paper sheets P. The image carrier driven roller 106 is rotationally driven by the rotation of the intermediate transfer belt 104.

The transfer roller 120 is disposed facing the image carrier driven roller 106. The transfer unit drive belt 130, which is an endless belt, is extended by the transfer roller 120, the transfer unit drive roller 126, and the transfer unit driven roller 128. The transfer unit drive roller 126, which is rotationally driven by a motor described later, conveys the transfer unit drive belt 130 in the sheet conveyance direction.

The cleaner 140, which is disposed under the transfer roller 120, includes a cleaning blade 142. The cleaning blade 142 abuts on the transfer unit drive belt 130 to remove the toner image adhering to the surface of the transfer unit drive belt 130. The cleaner 140 is provided with a lubricant for preventing damages by the toner image or the wax included therein.

As shown in FIGS. 1 and 2, the transfer unit pressing and separating mechanism 160, which is disposed around the transfer roller 120, moves the transfer roller 120, the transfer unit drive roller 126, the transfer unit driven roller 128, and the cleaner 140 unitedly closer to and separate from the intermediate transfer belt 104 so that the transfer roller 120 is pressed against and separated from the intermediate transfer belt 104. The transfer unit pressing and separating mechanism 160 may be of a known structure, and its configuration is not limited in this embodiment.

A large-capacity sheet feeding device 200, which is connected to the image forming apparatus 100 at an upstream part in the sheet conveyance direction, includes multiple tiers of sheet feeding trays 202, 204. In the sheet feeding trays 202, 204, paper sheets P such as thin paper sheets and thick paper sheets, those with different surface properties, or those in the same or different sizes are set. The large-capacity sheet feeding device 200 not only takes out suitable sheets P from the sheet feeding tray 202 or 204 to feed them to the transfer unit, but also changes trays according to a change command and feeds the sheets P from the other sheet feeding tray after the tray change. The number of the sheet feeding trays is not limited to two. The sheets P may be fed from a sheet feeder in the image forming apparatus 100 not shown in the drawings instead of the large-capacity sheet feeding device 200.

[Exemplary Block Configuration of Image Forming Apparatus]

Figure 3:
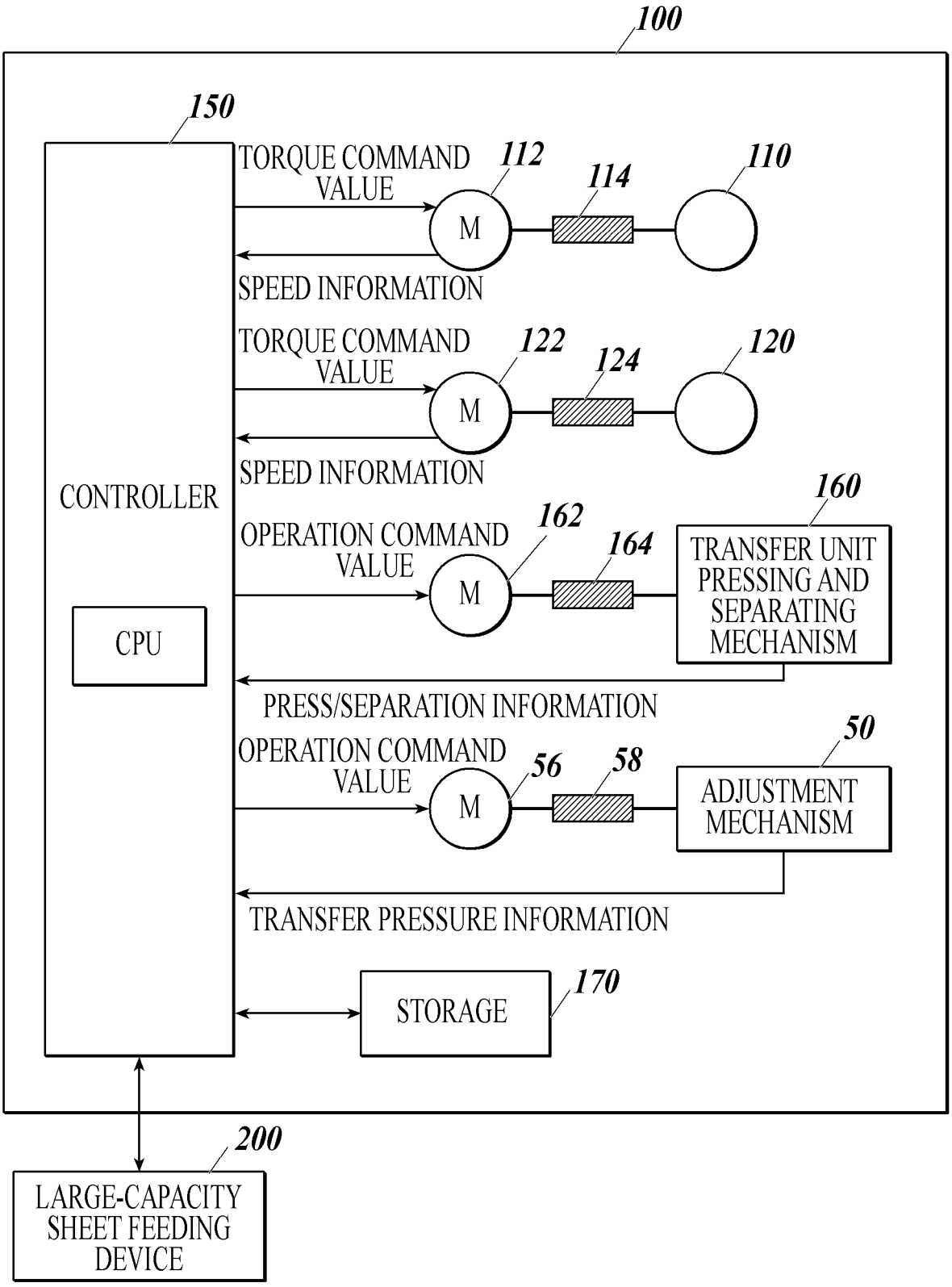
FIG. 3 is a block diagram showing a configuration of the image forming apparatus.

Next, an exemplary block configuration of the image forming apparatus 100, etc. is described. FIG. 3 shows an exemplary block configuration of the image forming apparatus 100. As shown in FIG. 3, the image forming apparatus 100 includes a controller 150 (hardware processor) that controls the operations of the whole apparatus. The controller 150 includes a central processing unit (CPU) 152. The CPU 152 reads out programs concerning a constant-speed control, constant torque control, image formation, etc. from a storage 170 and executes the programs, thereby controlling the operations of the transfer unit drive motor 122, etc. described later for the constant-speed control, the constant-torque control, etc.

The controller 150 is connected with the image carrier drive motor 112, the transfer unit drive motor 122, the transfer unit pressure and separation motor 162, the transfer pressure adjustment mechanism 167, and the storage 170. The image carrier drive motor 112 is composed of a brushless direct current motor, for example, and its drive axis is connected with the image carrier drive roller 110 via a drive power communicating mechanism 114. The image carrier drive motor 112 drives based on a torque command value provided by the controller 150, and rotates the image carrier drive roller 110 by that drive. The torque command value is a PWM signal for controlling the speed and the torque of the image carrier drive motor 112.

A rotation sensor not shown in the drawings is attached to the image carrier drive motor 112. The rotation sensor detects rotation of the image carrier drive motor 112, and feeds back speed information obtained by the detection to the controller 150. The rotation sensor may be a known one such as a Hall element, and the present invention is not limited to a specific one.

The transfer unit drive motor 122 is composed of a brushless direct current motor, for example, and its drive axis is connected with the transfer unit drive roller 126 via a drive power communicating mechanism 124. The transfer unit drive motor 122 drives based on a torque command value provided by the controller 150, and rotates the transfer unit drive roller 126 by that drive. The torque command value is a PWM signal for controlling the speed and the torque of the transfer unit drive motor 122. The transfer unit drive motor 122 is an example of the driver.

A rotation sensor not shown in the drawings is attached to the transfer unit drive motor 122. The rotation sensor detects rotation of the transfer unit drive motor 122, and feeds back speed information obtained by the detection to the controller 150. The rotation sensor may be a known one such as a Hall element, and the present invention is not limited to a specific one.

The transfer unit pressing and separating motor 162 is composed of a brushless direct current motor, for example, and its drive axis is connected with the transfer unit pressing and separating mechanism 160 via a drive power communicating mechanism 164. The transfer unit pressing and separating motor 162 causes the transfer pressing and separating mechanism 160 to operate based on operation command values provided by the controller 150, thereby causing the transfer roller 120 to be pressed to or to be separated from the intermediate transfer belt 104. A position detection sensor not shown in the drawings is attached to the transfer unit pressing and separating mechanism 160. The position detection sensor detects press and separation of the transfer roller 120, etc. and provides press/separation information to the controller 150.

Figure 4:
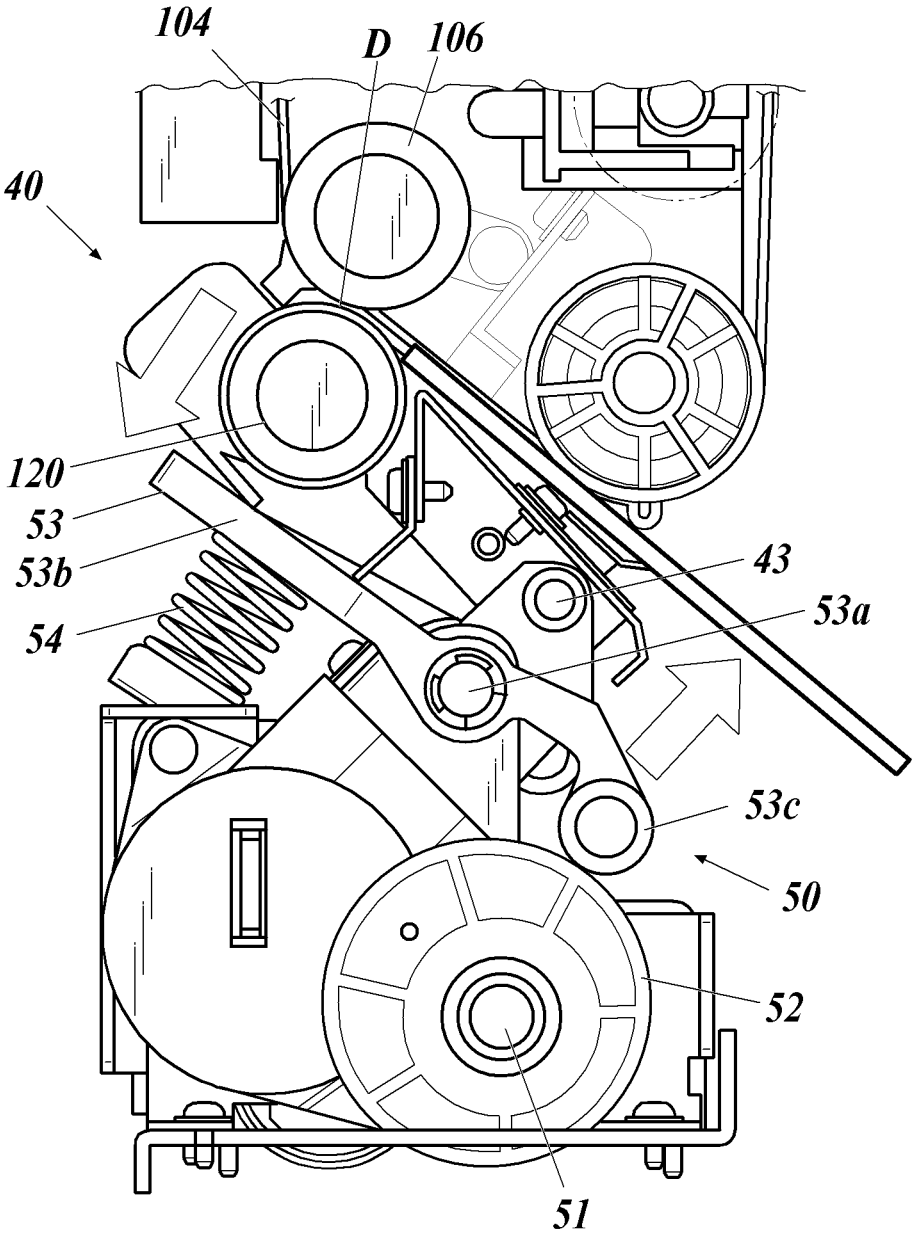
FIG. 4 schematically shows an exemplary configuration of the transfer unit with an adjustment mechanism.

The transfer unit 40 includes an adjustment mechanism 50 configured as shown in FIG. 4, for example. The adjustment mechanism 50 temporarily reduces a nip pressure (pressing force) applied by the transfer roller 120 which is moved to the pressing position by the transfer unit pressing and separating mechanism 160 onto the intermediate transfer belt 104 between the transfer roller 120 and the image carrier driven roller 106 when front and back ends of the sheet passes through the secondary transfer position D (between the transfer roller 120 and the intermediate transfer belt 104).

The transfer unit 40, which is unitized and pivotally supported by a unit support axis 43, swings around the unit support axis 43 to switch the positions of the transfer roller 120 between the pressing position and the separated position. The transfer roller 120 includes an axial center at a position separated from the unit support axis 43 by a predetermined distance toward the downstream part in the sheet conveyance direction. The switch of the positions of the transfer roller 120 is caused by the transfer unit pressing and separating mechanism 160.

The adjustment mechanism 50 includes a pressure reduction cam 52 which is attached to the rotation axis 51 driven by the adjustment mechanism drive motor 56 (see FIG. 3) in the same direction as the axis of the transfer roller 120, and a pressure reduction arm 53 which switches the positions of the transfer unit 40 from the pressing position in the direction for lowering the nip pressure by abutting to the pressure reduction cam 52 and swinging around the rotation fulcrum 53*a*.

An edge 53*b* of the pressure reduction arm 53 is a presser that presses the back face of the transfer unit 40 toward the intermediate transfer belt 104. The back face of the presser abuts to the upper end of a spring 54. A point in contact with the upper end of the spring 54 is the point of action of the pressure reduction arm 53 in pressure reduction. On contrary, the other end 53*c* of the pressure arm 53 is the point of force from the pressure reduction cam 52.

In the transfer unit 40, the pressure reduction cam 52 of the adjustment mechanism 50 is rotated at a predetermined angle (rotation position) to switch its positions to abut to and press up the point of force of the pressure reduction arm 53 (another end 53*c*) as shown in FIG. 4, and the pressure reduction arm 53 rotates slightly counterclockwise around the rotation fulcrum 53*a* to switch its positions to presses back the spring 54 at the point of action at the end (one end 53*b*) opposite to the point of force with the rotation fulcrum 53*a*. The nip pressure is thereby reduced in the transfer unit 40. In the transfer unit 40, when the pressure reduction cam 52 is at a position at an angle which does not allow the pressure reduction cam 52 to abut to or press the point of force of the pressure reduction arm 53, the pressure reduction arm 53 is biased by the spring 54 at the point of action. The nip pressure is thereby maintained at a regular pressure (pressure in image transfer) in the transfer unit 40.

The adjustment mechanism drive motor 56 is composed of a brushless direct current motor, for example, and its drive axis is connected with the adjustment mechanism 50 via a drive power communicating mechanism 58. The adjustment mechanism drive motor 56 causes the adjustment mechanism 50 to operate based on operation command values provided by the controller 150, thereby causing the nip pressure to be a regular pressure (pressure in image transfer) or to be a reduced pressure lower than the regular pressure (including zero pressure). A pressure detection sensor not shown in the drawings is attached to the adjustment mechanism 50. The pressure detection sensor detects a reaction pressure against the transfer roller 120, and provides transfer pressure information to the controller 150.

A storage 170 is composed of, for example, a read only memory (ROM), a random access memory (RAM), etc., and stores programs for executing the constant-speed control, the constant-torque control, the image formation, etc. The storage 170 stores therein speed information for the constant-speed control, torque command values for the constant-torque control, values for calculation of increase in the load torque, its factors, or its influences, setting threshold values, etc.

The large-capacity sheet feeding device 200 is connected to the controller 150 of the image forming apparatus 100 via a communication unit not shown in the drawings, and feeds sheets P or changes the sheet feeding trays based on the command information provided by the controller 150 of the image forming apparatus 100.

[Exemplary Basic Operations of Image Forming Apparatus]

Next, exemplary basic operations of the image forming apparatus 100 are described with reference to FIGS. 1 to 3. First, an exemplary operation of the intermediate transfer belt 104 is described. At the start of a job, the controller 150 rotates the image carrier drive roller 110 at a constant speed by providing a torque command value of a PWM signal to the image carrier drive motor 112. The controller 150 generates the torque command values based on the information on the torque command values stored in the storage 170.

The rotation of the image carrier drive motor 112 is detected by a rotation sensor not shown in the drawings, and the results of the detection are fed back to the controller 150 as the speed information. The controller 150 determines whether the speed of the image carrier drive motor 112 is in a speed range set based on the speed information, and maintains the current torque command value if the speed is in the set range. If the speed is below the set range, the controller 150 generates an increased torque command value and controls drive of the image carrier drive motor 112. If the speed is above the set range, the controller 150 generates a decreased torque command value and controls drive of the image carrier drive motor 112 so that the speed is in the set range. This enables the rotation control of the intermediate transfer belt 104 to rotate at a constant speed.

Next, an exemplary operation of the transfer roller 120 is described. The rotation of the transfer roller 120 is controlled differently depending on whether the transfer roller 120 is pressed against and separated from the intermediate transfer belt 104. When the controller 150 detects that the transfer roller 120 is in a state separated from the intermediate transfer belt 104, the controller 150 rotates the transfer unit drive roller 126 at a constant speed by providing a torque command value of a PWM signal to the transfer unit drive motor 122. The controller 150 generates the torque command values based on the information on the torque command values stored in the storage 170. The controller 150 may determine whether the transfer roller 120 is in a state pressed to or separated from the intermediate transfer belt 104 based on results of detection of a position of a member moving along with the transfer roller 120 in the pressing/separating motion.

The rotation of the transfer unit drive motor 122 is detected by a rotation sensor not shown in the drawings, and results of the detection are fed back to the controller 150 as the speed information. The controller 150 determines whether the speed of the transfer unit drive motor 122 is in a speed range set based on the speed information, and maintains the current torque command value if the speed is in the set range. If the speed is below the set range, the controller 150 generates an increased torque command value and controls drive of the transfer unit drive motor 122. If the speed is above the set range, the controller 150 generates a decreased torque command value and controls drive of the transfer unit drive motor 122 so that the speed is in the set range. This enables the rotation control of the transfer roller 120 to rotate at a constant speed.

The speed of the transfer roller 120 driven by the transfer unit drive roller 126 via the transfer unit drive belt 130 may be set at a constant speed to be the same as the intermediate transfer belt 104, or may be increased to be faster than the rotation speed of the intermediate transfer belt 104 by a predetermined value.

The controller 150 detects the drive torque in the transfer unit drive motor 122 as a constant-speed drive torque when the transfer roller 120 is in the constant-speed control. The constant-speed drive torque may be detected by a torque detector. For example, the torque detector is interposed between the transfer unit drive motor 122 and the transfer unit drive roller 126 to be in connection, and detects the drive torque for a constant speed by the spring amount.

In the case where the PWM signal is used as described above, the torque may be detected by analysis of the PWM signal as the torque command value. In detection of the torque, it is preferable to adopt values with small deviations by using an average value in a predetermined period of time. A detection time of the constant-speed drive torque may be suitably set as long as the drive torque is detected, and it is not necessary to keep detecting the torque while it is detectable.

Next, in the state where the transfer roller 120 is pressed against the intermediate transfer belt 104, the controller 150 performs the constant-speed drive torque control of the transfer unit drive motor 122 according to the constant-speed drive torque of the transfer unit drive motor 122 detected in the constant-speed control of the transfer roller 120. In this control, the torque value may be the same as the value of the constant-speed drive torque detected in the constant-speed control, but more preferably, the constant-torque control is performed according to the torque value greater than the constant-speed drive torque, considering fluctuation of the drive torque during the rotation of the transfer unit drive motor 122. The value is preferably in a fluctuation range of the drive torque. The fluctuation range of the drive torque may be obtained beforehand by collecting the operation data of the transfer unit drive motor 122.

Alternatively, in the constant-speed control of the transfer roller 120, the speed of the transfer roller 120 is set to a value greater than the speed of the intermediate transfer belt 104, and thereby setting the torque value in the constant-torque control to the detected constant-speed drive torque. The detected constant-speed drive torque is to be a value greater than the torque value of the transfer roller 120 detected in the constant-speed control at the same speed as the intermediate transfer belt 104. This enables the constant-torque control based on the torque value greater than the torque value of the transfer roller 120 detected in the constant-speed control at the same speed as the intermediate transfer belt 104. As the fluctuation range is within the difference between these torque values, it is possible not to cause fluctuations in the torque of the intermediate transfer belt 104 even when the drive torque of the transfer unit drive motor 122 varies. In this regard, the rotation speed of the transfer roller in the constant-speed control at a speed faster than the intermediate transfer belt 104 is to be determined.

The transfer unit is switched from the separated state to the pressed state at the start of image formation, for example. The transfer unit is switched to the separated state from the pressed state at the end of a job or a waiting job, for example. The constant-torque control of the transfer unit drive motor 122 by the torque detection of the transfer unit drive motor 122 may be performed from the end of each of continuous jobs until the start of the next, and the rotation control may be performed with appropriate torque command values by adjusting the torque command values in the constant-torque control.

[Exemplary Operation of Tray Change of Image Forming Apparatus]

Figure 5:
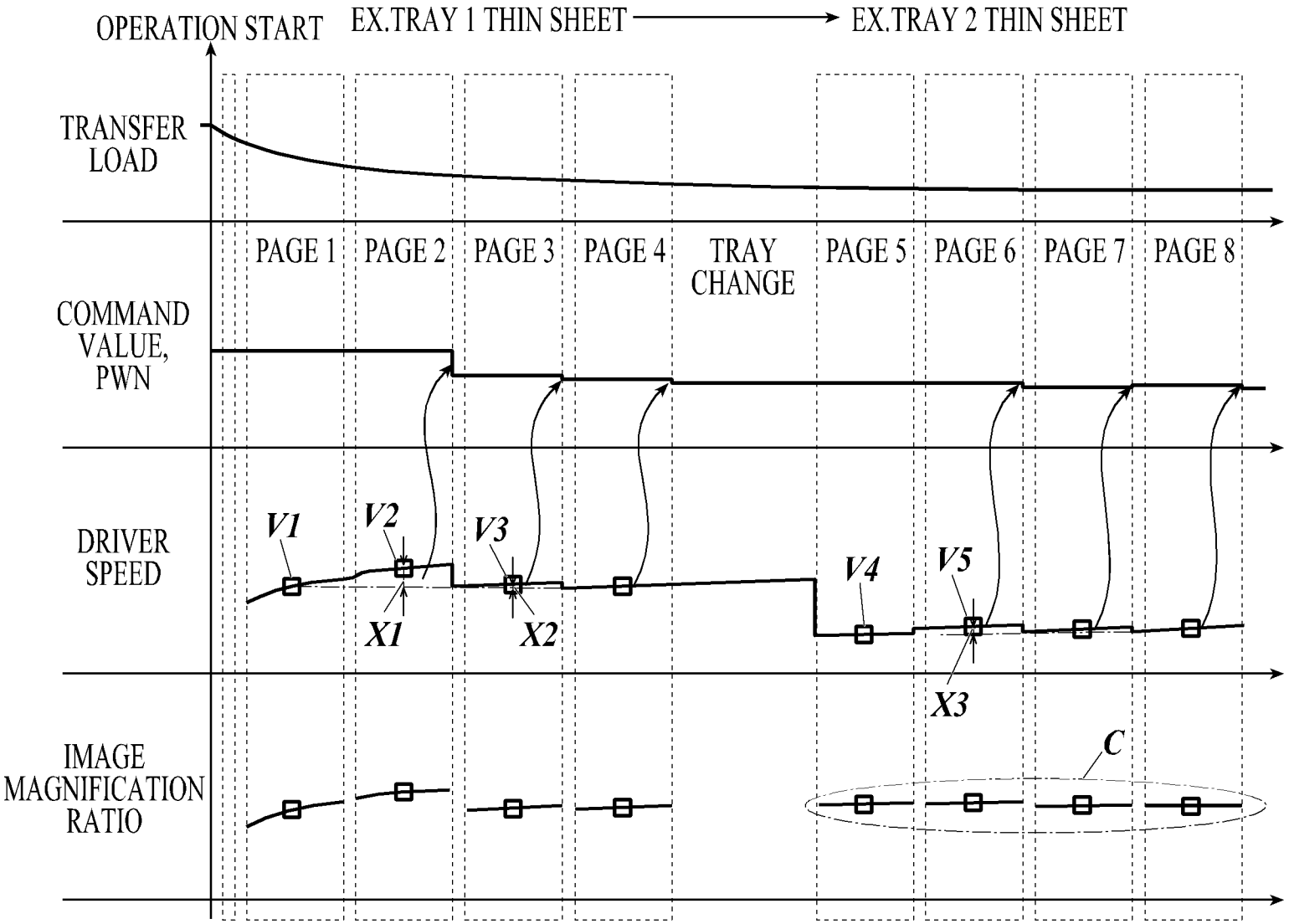
FIG. 5 shows an exemplary control of the transfer unit in a case where trays are changed in a constant-torque control.

Next, an exemplary operation of the image forming apparatus 100 when trays are changed during continuous image formation (while the transfer unit is pressed against the image carrier) is described. FIG. 5 shows an example of the control of the transfer unit when the trays are changed during continuous image formation in the image forming apparatus 100. Specifically, Section A of FIG. 5 shows the variation of the transfer load, in which the vertical axis is the transfer load and the horizontal axis is the time. Section B of FIG. 5 shows the torque command value (PWM signals) of the transfer unit drive motor 122, in which the vertical axis is the torque command value and the horizontal axis is the time. Section C of FIG. 5 shows the speed of the transfer unit motor 122, in which the vertical axis is the speed and the vertical axis is the time. Section D of FIG. 5 shows the magnification ratio of the image to be transferred onto the sheet P, in which the vertical axis is the image magnification ratio and the horizontal axis is the time.

The transfer load is gradually decreased along the time in the image forming operation, influenced by the fluctuation of loads of the lubricant of the cleaner 140, etc. as shown in Section A of FIG. 5.

At the start of the image forming operation, the controller 150 controls the transfer unit pressing and separating mechanism 160 so that the transfer roller 120 is pressed against the intermediate transfer belt 104, and then performs the constant-torque control on the transfer unit drive motor 122. The torque command value is a torque value of the constant-speed drive torque detected in the constant-speed control when the transfer roller 120 is in the separated state (Section B of FIG. 5).

At the start of the image forming operation, the speed (rotation speed) of the transfer unit drive motor 122 in passage of each sheet P is measured. The controller 150 calculates the average speed V1 (hereinafter also referred to as the reference speed) from the measured speed of the transfer unit drive motor 122 during the passage of the first sheet P (Section C of FIG. 5), and stores the calculated average speed V1 as the reference value in the storage 170. The controller 150 then calculates the average speed V2 from the measured speed of the transfer unit drive motor 122 during the passage of the second sheet P (Section C of FIG. 5).

The controller 150 reads out the reference value of the speed of the transfer unit drive motor 122 during the passage of the first sheet from the storage 170, calculates a difference X1 between the read out reference value and the measured and calculated value of the average speed V2 of the transfer unit drive motor 122 during the passage of the second sheet, and feeds back the difference X1 to the torque command value for the subsequent third sheet. As a result, the torque command value for the third sheet is decreased according to the difference X1, and the speed of the transfer unit drive motor 122 of the next sheet can be returned to the reference speed (Section B of FIG. 4, Section C of FIG. 5).

Next, the controller 150 calculates the average speed V3 of the transfer unit drive motor 122 during the passage of the third sheet P. The controller 150 calculates a difference X2 between the measured and calculated value of the average speed V3 of the transfer unit drive motor 122 during the passage of the third sheet P and the reference value of the speed of the transfer unit drive motor 122 during the passage of the first sheet stored in the storage 170, and feeds back the difference X2 to the torque command value of the subsequent fourth sheet (Section B of FIG. 5, Section C of FIG. 5). In this example, the feedback control as described above is repeated until the trays are changed.

When the fourth sheet P passes through, the trays are changed while the transfer roller 120 is in the pressed state (during the continuous operation). For example, the trays are changed from the sheet feeding tray loaded with thin paper sheets to the other sheet feeding tray loaded with thick paper sheets in the large-capacity sheet feeding device 200. When the tray change is completed, the controller 150 determines whether the sheet P fed by the sheet feeding tray is the first sheet P after the tray change. In this example, the fifth sheet P from the start of the job is the first sheet P after the tray change.

If the controller 150 determines that the fifth sheet P is the first sheet P after the tray change, the controller 150 calculates the average speed V4 of the transfer unit drive motor 122 during the passage of the fifth sheet P (Section C of FIG. 5), and stores the calculated average speed V4 as the reference value in the storage 170. That is, the reference value first stored before the tray change is updated to the average speed for the first sheet after the tray change. After the trays are changed, the feedback control is not performed for the torque command value for the subsequent sheet because the reference speed is newly set. Thus, the torque command value for the sixth torque command value is used unchanged, as the torque command value for the sixth sheet.

The torque command value for the fifth sheet is equal to the value for the fourth sheet. However, as the sheets P are changed to thick sheets, the average speed (rotation speed) V4 of the transfer unit drive motor 122 is decreased in comparison to the speed before the tray change where thin sheets P are used because of the change in diameter, etc. (Section C of FIG. 5). As a result, the speed on the surface of the sheet P facing the transfer unit roller 120 passing through between the transfer roller 120 and the intermediate transfer belt 104 is decreased along with the decrease in the speed of the transfer unit drive motor 122, but the surface of the sheet P facing the intermediate transfer belt 104 is conveyed at a speed equal to that of the intermediate transfer belt 104. Thus the image magnification ratio may be maintained in a normal range (C in Section D of FIG. 5).

When the passage of the fifth sheet P is completed, the sixth sheet P is fed. The controller 150 calculates the average speed V5 of the transfer unit drive motor 122 during the passage of the sixth sheet P (Section C of FIG. 5). The controller 150 calculates a difference X3 between the measured and calculated value of the average speed V5 of the transfer unit drive motor 122 during the passage of the sixth sheet and the reference value of the speed of the transfer unit drive motor 122 stored in the storage 170, and feeds back the difference X3 to the torque command value for the subsequent seventh sheet. As a result, the torque command value for the seventh sheet is decreased according to the difference X3, and the speed of the transfer unit drive motor 122 of the next sheet may be returned to the reference speed (Section B of FIG. 5, Section C of FIG. 5).

The average speed V5 of the transfer unit drive motor 122 for the sixth sheet P is substantially equal to the average speed V4 of the transfer unit drive motor 122 for the fifth sheet P (Section C of FIG. 5). Thus the speeds of the front and back surfaces of the fifth sheet can be equal, and the image magnification ratio can be normally maintained after the trays are changed (C in Section D of FIG. 5).

The average speed V4 as the reference value of the transfer unit drive motor 122 during the passage of the first sheet P after the tray change, namely the fifth sheet P from the start of the job, is used for the seventh and subsequent sheets P, and the feedback control of the torque command value is performed for the next sheet. As the average speed of the transfer unit drive motor 122 for the seventh sheet P is substantially equal to the average speed V4 of the transfer unit drive motor 122 for the fifth sheet P (Section C of FIG. 5), the image magnification ratio can be maintained in a normal range (Section D of FIG. 5).

In the above embodiment, in the case where the trays are changed for the sheet type change during the continuous operation, the average speed of the transfer unit drive motor 122 during the passage of the first sheet P after the tray change is set as the reference value. This makes it possible to maintain the speed of the surface of the sheet P relative to the intermediate transfer belt 104. For example, even in the case where the average speed of the transfer unit drive motor 122 is decreased by the influence of the sheet type change from the thin sheets to thick sheets in the tray change, the feedback control of the torque value is performed with reference to the passage speed of the sheet P after the tray change, and the speed of the transfer unit changed by the thickness of the sheets is prevented from being fed back. As a result, it is possible to reliably prevent the image magnification ratio from being varied after the tray change.

Further, according to the above embodiment, it is possible to appropriately maintain the torque relation with the intermediate transfer belt 104 not only against environmental and chronological long-term variations in the load applied to the transfer unit of the transfer roller 120, etc. but also against short-term variations at the start of a printing operation, and minimize fluctuations of the image magnification ratio due to short-term variations in the load, while preventing deterioration of the image quality by minimizing unnecessary fluctuations of the load on the intermediate transfer belt 104.

<2> Countermeasures Against Increased Load Torque

[Explanation for Variation in Image Magnification Ratio]

In the case where the trays are changed during the continuous operation repeatedly and the average speed of the transfer unit drive motor 122 during the passage of the first sheet P after the tray change is newly memorized as the reference speed each time as described in <1> above (no absolute value), the image magnification ratio is gradually varied in some cases.

Figure 6:
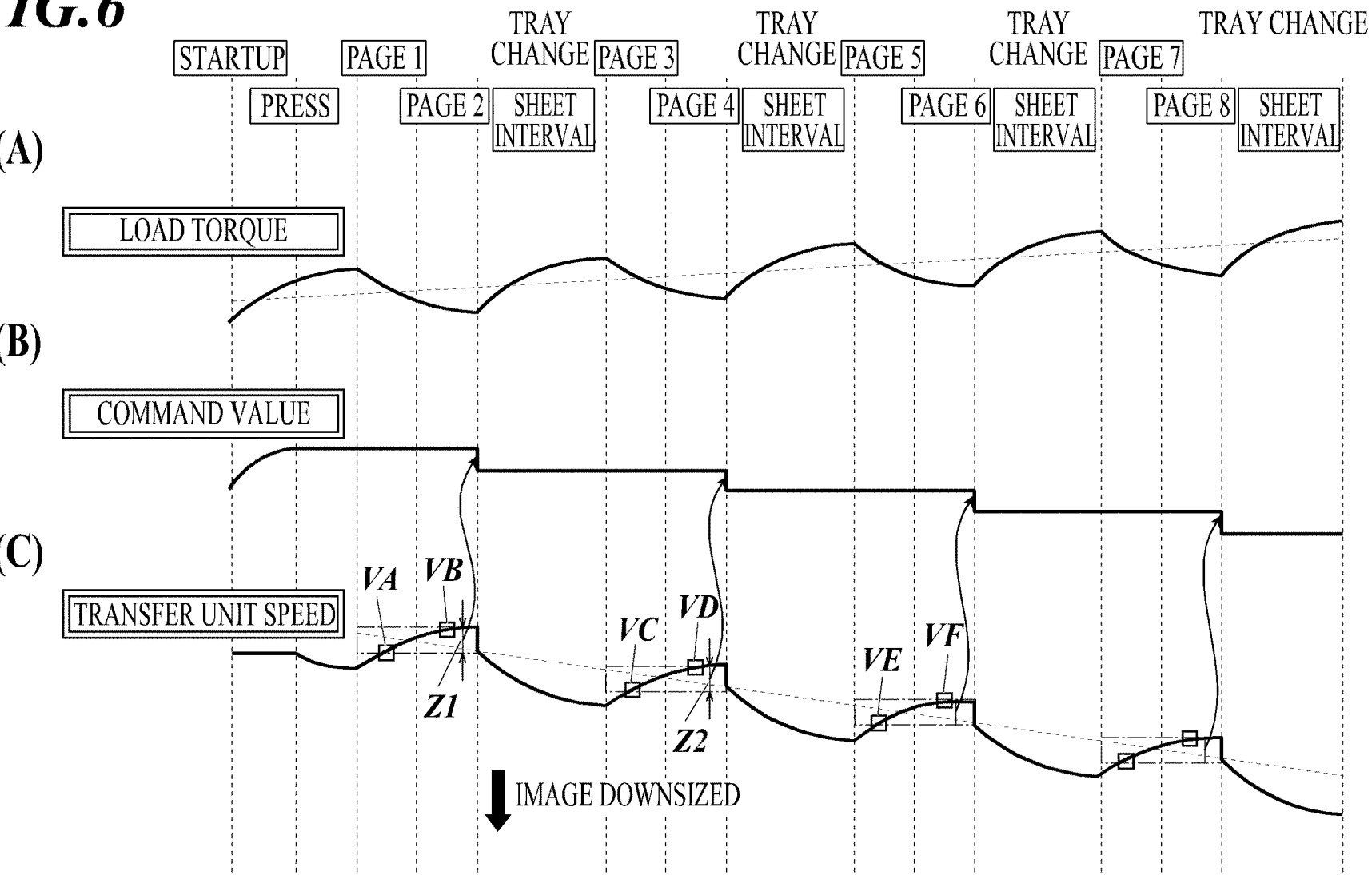
FIG. 6 shows an exemplary control of the transfer unit in a case where trays are repeatedly changed in the constant-torque control.

FIG. 6 is an explanatory drawing showing a situation where the image magnification ratio is varied in repeated tray changes. Section A of FIG. 6 shows the variation of the load torque, in which the vertical axis is the load torque and the horizontal axis is the time. Section B of FIG. 6 shows the torque command value for the transfer unit drive motor 122, in which the vertical axis is the torque command value and the horizontal axis is the time. Section C of FIG. 6 shows the speed of the transfer unit drive motor 122, in which the vertical axis is the speed and the horizontal axis is the time. FIG. 6 is shown under the following conditions as an example. However, the present invention is not limited to this example.

1. The thickness of the sheets is consistent before and after the tray change (speed of transfer unit=image magnification ratio).
2. The intervals (idling of the transfer unit) between the sheets are assumed to be longer than usual due to the limitation of the number of the sheets circulated in the tray change.

a) The load torque is increased by the load fluctuation of the cleaner in idling between sheets.

b) The load torque is decreased in passage of a sheet after idling between sheets, and the speed of the first sheet is slower than that of the second sheet with a fixed torque command value; and c) From the above a) and b), the torque command value is decreased compared to the previous state for the second and consecutive sheets after the tray change.

3. The trays are changed for every two pages.

Hereinafter, the above situation is described in detail. When the first sheet and then the second sheet passes through after the transfer roller 120 has come to the pressed state, the load torque is gradually decreased by the decrease in the lubricant, etc. (Section A of FIG. 5). On contrary, the speed of the transfer roller 120 is increased according to the decrease in the lord torque (Section C of FIG. 6). At this time, the speed of the transfer roller 120 during the passage of the second sheet is faster than that of the transfer roller 120 during the passage of the first sheet.

The controller 150 sets the reference value to the average speed of the transfer unit drive motor 122 (also referred to as the reference speed) measured during the passage of the first sheet P, calculates a difference Z1 between reference speed and the average speed VB of the transfer unit drive motor 122 measured during the passage of the second sheet P, and feeds back the difference Z1 to the torque command value for the subsequent third sheet (Section B of FIG. 6, Section C of FIG. 6). As a result, the torque command value for the three sheet is lowered by the difference Z1.

The trays are changed after the second sheet P passes through. As the transfer roller 120 idles for a longer time in an interval between sheets during the tray change, the load torque of the transfer roller 120 is increased by influence of the lubricant, etc. described above (Section C of FIG. 6). The speed of the transfer unit drive motor 122 is gradually decreased by the decreased torque command value and the increased load torque.

When the tray change is completed, the third and subsequent sheets start to pass through. The average speed VC of the transfer unit drive motor 122 during the passage of the third sheet P is slower than the average speed VA of the transfer unit drive motor 122 during the passage of the first sheet before the tray change.

As the third and subsequent sheets pass through, the load torque is gradually decreased due to the decrease in the lubricant, etc. (Section A of FIG. 6). On contrary, the speed of the transfer unit drive motor 122 is increased with the decrease in the load torque (Section C of FIG. 6). The images transferred onto the third and fourth sheets P are downsized from those transferred onto the first and second sheets P, because the average speeds VC and VD of the transfer unit drive motor 122 are slower than the average speed VA before the tray change, decreasing the speed of conveyance of the sheets P.

The controller 150 calculates a difference Z2 between the average speed VC of the transfer unit drive motor 122 measured during the passage of the third sheet P as the reference speed and the average speed VD of the transfer unit drive motor 122 measured during the passage of the fourth sheet P, and feeds back the difference Z2 to the torque command value for the subsequent fifth sheet (Section B of FIG. 6, Section C of FIG. 6). As a result, the torque command value for the fifth sheet is decreased by the difference Z2.

The trays are changed after the fourth sheet P passes through. As the transfer roller 120 idles for a longer time in intervals between sheets during the tray change, the load torque of the transfer unit drive motor 122 is increased by influence of the lubricant, etc. described above (Section A of FIG. 6). The speed of the transfer unit drive motor 122 is gradually decreased by the decreased torque command value and the increased load torque.

When the tray change is completed, the fifth and subsequent sheets start to pass through. The average speed VE of the transfer unit drive motor 122 during the passage of the fifth sheet P is slower than the average speed VC of the transfer unit drive motor 122 during the passage of the third sheet before the tray change.

As the fifth and subsequent sheets pass through, the load torque is gradually decreased due to the decrease in the lubricant, etc. (Section A of FIG. 6). On contrary, the speed of the transfer unit drive motor 122 is increased with the decrease in the load torque (Section C of FIG. 6). The images transferred onto the fifth and sixth sheets P are downsized those transferred onto the third and fourth sheets P, because the average speeds VE and VF of the transfer unit drive motor 122 are slower than the average speed VC before the tray change, decreasing the speed of conveyance of the sheets P.

As described above, in the case the average speed for the first sheet which is decreased after the tray change is newly memorized as the reference speed every time the trays are changed, the image magnification ratio is gradually varied in some cases.

[Countermeasures]

In order to deal with the problem of the gradual change in the image magnification ratio described above, when the controller 150 determines that a calculated increase in the torque load on the transfer unit 40, a factor or influence of the increase exceeds a predetermined threshold value (hereinafter referred to as a load torque index), the controller 150 forcibly sets the reference value to the speed of the driver (the transfer unit drive motor 122) detected by the speed detector while the pressure is slightly reduced from that during the image transfer by the adjustment unit 50.

Figure 7:
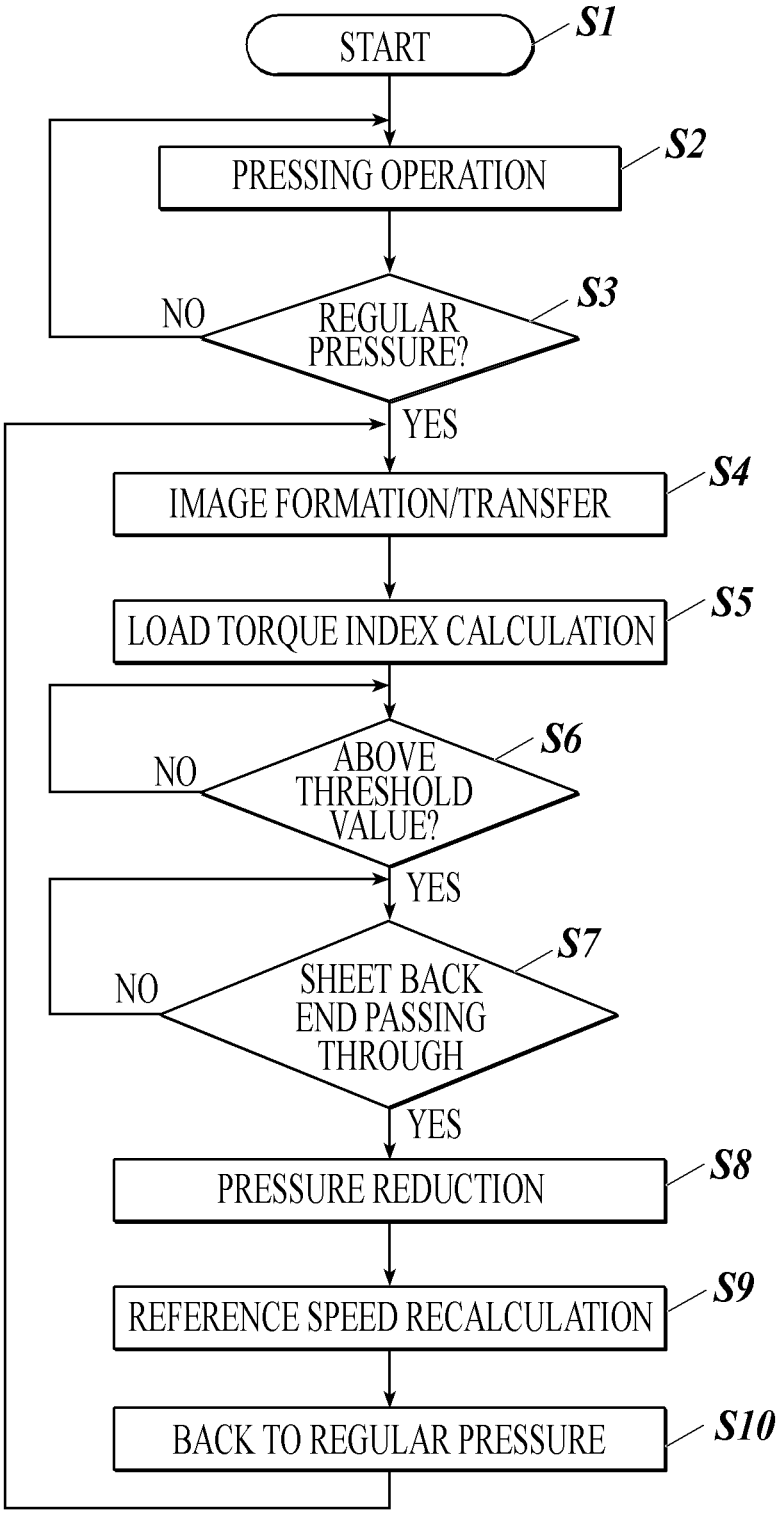
FIG. 7 is a flowchart showing an exemplary operation of the image forming apparatus in a case where a reference speed value is forcibly set in the constant-torque control.
Figure 8:
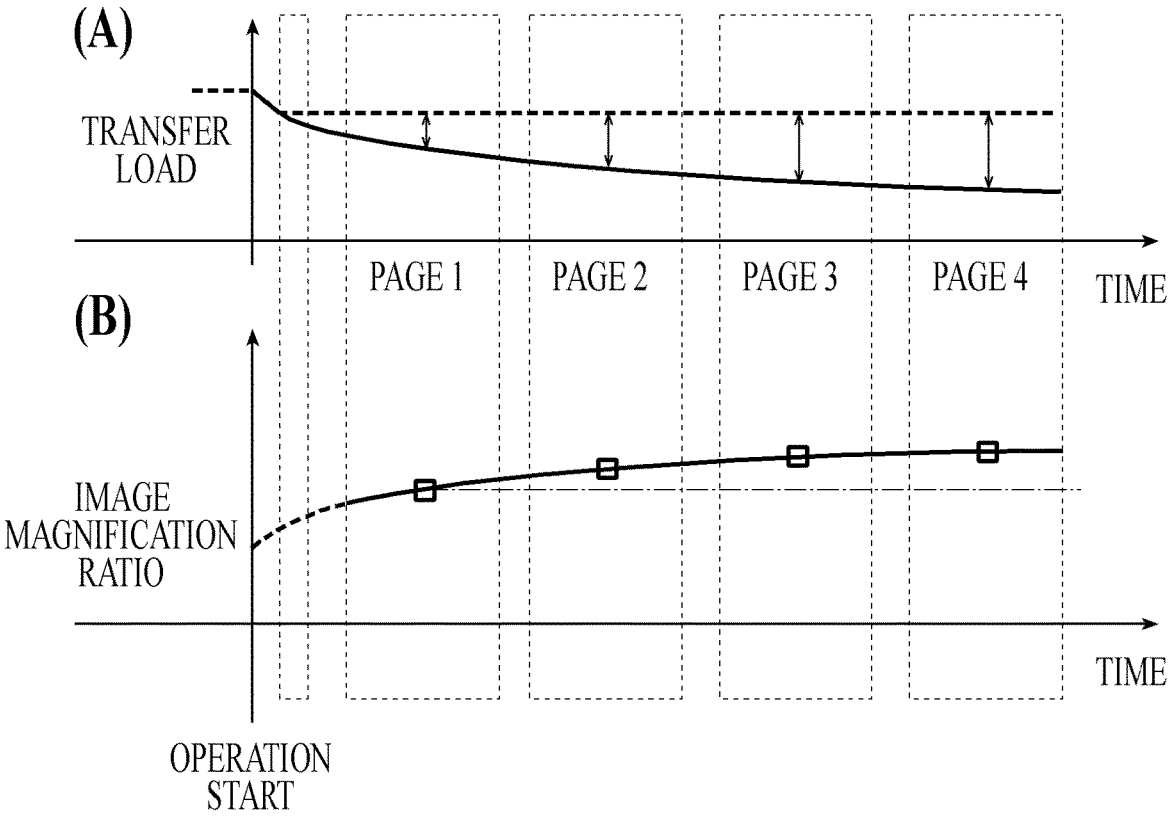
FIG. 8 shows an exemplary relation between a transfer load and an image magnification ratio in a conventional technique.
Figure 9:
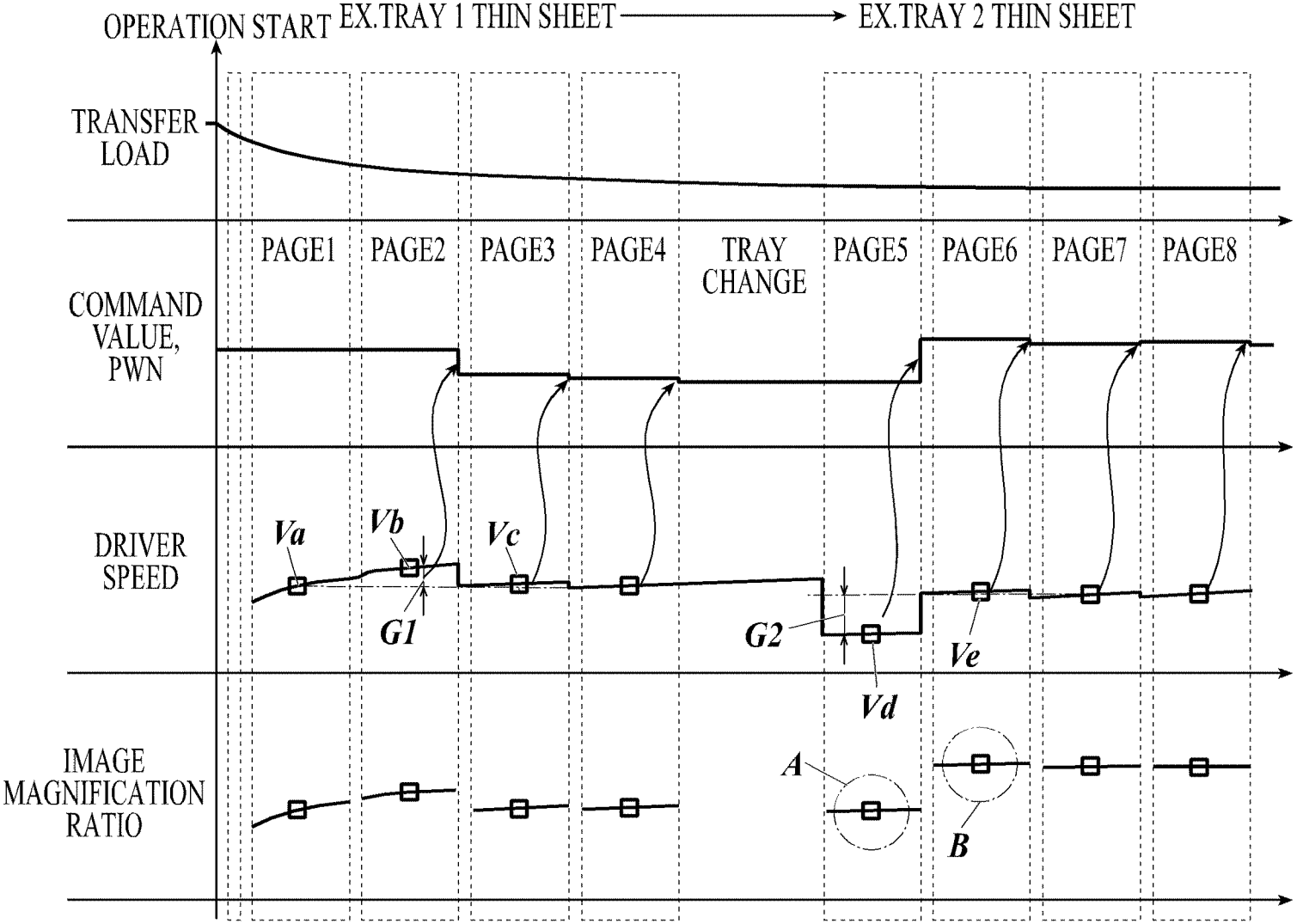
FIG. 9 is an explanatory drawing showing a method of feedback of the difference to the next sheet.

Refer to a flowchart of FIG. 7. The controller 150 starts up the image forming apparatus 100 (51), and causes the transfer unit 40 and the intermediate transfer belt 104 to be pressed against each other using the transfer unit pressing and separating mechanism 160 (S2).

The controller 150 proceeds to image formation and image transfer onto a sheet while the adjustment mechanism 50 is in an adjustment state with a regular pressure (S3, S4).

The controller 150 counts a load torque index (S5). One, two or more in combination are selected from the following A1 to A4 as the load torque index.

(A1) The controller 150 detects the load torque on the transfer unit 40 by the torque detector.

(A2) The controller 150 measures time intervals between one sheet and the next one passing through the transfer unit 40. Further, the threshold value may be a regular time interval during which the trays are changed in the sheet feeding device that feeds sheets to the transfer unit 40. Such a threshold value makes it possible to detect an abnormal increase in the time elapsed in intervals between sheets with and without the tray change by the increase in the load torque. Alternatively, the threshold value may be smaller than the regular time interval during which the trays are changed in the sheet feeding device that feeds sheets to the transfer unit 40. In that case, it is necessary that the reference value is forcibly set each time the trays are changed.

(A3) The controller 150 counts the number of the sheets passing through the transfer unit 40. The increase in the load torque is estimated by the number of the sheets, because an increase in the number of the sheets is a factor of the increase in the load torque. In that case, the controller 150 further multiplies the number of the sheets passing through the transfer unit 40 by a weighting coefficient which is set to a greater value for thicker sheets by threshold values. The thicker the sheets are, the more they affect the increase in the load torque. Here, the thickness of the sheets is presumed by the pressure detection sensor attached to the adjustment mechanism 50. The thickness of the sheets may be estimated from the sheet information (paper type, basis weight, etc.).

(A4) The controller 150 measures the decrease in the speed of the transfer unit drive motor 122 while the sheets are not passing through the nip part. That is because the increase in the load torque can be estimated by the decrease in the speed, as the decrease in the speed is due to the increase in the load torque.

The controller 150 then determines whether the load torque index (A1-A4) exceeds a predetermined threshold value (S6).

The threshold value is set beforehand to a value that correlates with unacceptable influence on the image magnification ratio.

If YES at Step S6 and if the back end of the sheet passes through the transfer nip part (YES at S7), then the controller 150 reduces the nip pressure to a predetermined value by controlling the adjustment mechanism 50 (S8). The predetermined value may be zero or a value higher than zero and lower than the normal pressure. The transfer unit 40 may be separated from the intermediate transfer belt 104.

The controller 150 forcibly sets the reference value to the speed of the transfer unit drive motor 122 detected by the speed detector (the rotation sensor of the transfer unit drive motor 122) while the nip pressure is reduced to the predetermined value (S9), restarts the image transfer operation after the nip pressure is returned to normal, and performs the above feedback (S10). That is, in the period between the fifth and sixth sheets in FIG. 6, the speed measured at Step S9 is set as the reference value instead of the speed VE and performs the feedback control of the torque command value.

This makes it possible to prevent the gradual decrease in the speed of the transfer unit which leads to the gradual downsizing of the image to an unacceptable extent, as the reference value is adjusted upward and the torque command value is also adjusted upward. Moreover, it is not necessary to cause the transfer unit to be in the separated state by the transfer unit pressing and separating mechanism 160, perform the constant-speed control, and reacquire the constant-speed drive torque in the constant-speed control.

As a result, it is possible to normally maintain the magnification of the transferred image without reducing the efficiency in the whole job in which the toner image is successively transferred onto multiple sheets.

In the operation shown in FIG. 6, the determinations at Steps S5 and S6 may be performed as appropriate, and the operations at Steps S8 to S10 may be performed in any time interval between sheets with a regular spacing (without the tray change) or in a time interval during which the trays are changed (with the tray change).

Alternatively, those steps may be performed only in a time interval during which the trays are changed, which brings more efficiency.

Though the embodiment according to the present invention has been described in detail, the present invention is not limited to the above embodiment, and changes can be made within the scope of the present invention. The intermediate transfer belt exists as a premise in the above embodiment, but the present invention may be applied to an image forming apparatus that does not perform intermediate transfer. It is possible to obtain similar effects in an image forming apparatus in which the transfer unit is pressed against the photoreceptor as the image carrier.

The sheets P are changed from thinner ones to thicker ones with the tray change in the above embodiment, but the sheets P may be changed from thicker ones to thinner ones.

What is claimed is:

1. An image forming apparatus comprising:

an image carrier that carries a toner image;

a transfer unit that is capable of being pressed against and separated from the image carrier and that transfers the toner image carried by the image carrier onto a sheet when the transfer unit is pressed against the image carrier;

a driver that rotationally drives the transfer unit according to a command value;

a hardware processor that sets the command value for a constant-speed control and a constant-torque control of the driver;

wherein in the constant-speed control, the driver drives the transfer unit at a constant speed, wherein in the constant-torque control, the driver drives the transfer unit with a constant torque, an adjustment mechanism that adjusts a pressure with which the transfer unit is pressed against the image carrier; and a speed detector that detects a speed of the driver, wherein the hardware processor performs the constant-torque control of the driver based on a constant-speed drive torque while the transfer unit is pressed against the image carrier, the constant-speed drive torque being detected in the constant-speed control of the driver while the transfer unit is separated from the image carrier, wherein in the constant-torque control, the hardware processor performs a feedback control in which the hardware processor sets a reference value to an average speed of the driver during passage of a first sheet through the transfer unit and calculates a difference between the reference value and a measured value of an average speed of the driver during passage of a second or subsequent sheet through the transfer unit so as to derive the command value for a sheet next to the second or subsequent sheet from the difference, wherein the hardware processor measures at least one of an increase in a load torque, a factor of the increase, and influence of the increase and makes a determination as to whether a measurement result exceeds a threshold value, and in response to the measurement result exceeding the threshold value, the hardware processor performs the feedback control in which the hardware processor forcibly sets the reference value to the speed of the driver that is detected by the speed detector while the pressure is reduced by the adjustment mechanism from a value during image transfer.

2. The image forming apparatus according to claim 1, wherein the hardware processor measures a time interval between a sheet and a next sheet that pass through the transfer unit and makes the determination as to whether the time interval exceeds the threshold value.

3. The image forming apparatus according to claim 2, wherein the threshold value is a time interval that is normally interposed when a tray that feeds sheets in a sheet feeding device to the transfer unit is changed.

4. The image forming apparatus according to claim 1, wherein the hardware processor counts a number of sheets that have passed through the transfer unit and makes the determination as to whether the counted number exceeds the threshold value.

5. The image forming apparatus according to claim 4, wherein the hardware processor multiplies the counted number of the sheets that have passed through the transfer unit by a weighting coefficient and makes the determination as to whether the multiplied value exceeds the threshold value, wherein the weighting coefficient is greater for the sheets having a greater thickness.

6. The image forming apparatus according to claim 1, wherein the hardware processor measures a decrease in the speed of the driver and makes the determination as to whether the decrease exceeds the threshold value.

7. The image forming apparatus according to claim 1, wherein after a tray change is performed during a continuous operation so that a tray that feeds sheets in a sheet feeding device to the transfer unit is changed, the hardware processor changes the reference value to an average speed of the driver during passage of a first sheet after the tray change through the transfer unit and calculates a difference between the changed reference value and a measured value of an average speed of the driver during passage of a second or subsequent sheet after the tray change through the transfer unit so as to derive the command value for a sheet next to the second or subsequent sheet from the difference.

8. The image forming apparatus according to claim 7, wherein while the tray change in the sheet feeding device is performed, the hardware processor forcibly sets the reference value to the speed of the driver that is detected by the speed detector while the pressure is reduced by the adjustment mechanism from the value during the image transfer.

* * * * *